United States Patent [19]

Ruhe et al.

[11] 4,290,388

[45] Sep. 22, 1981

[54] VAPOR GENERATOR

[75] Inventors: Anthony Ruhe, Fonthill; Peter J. Adams, Niagara Falls, both of Canada

[73] Assignee: Foster Wheeler Limited, St. Catharines, Canada

[21] Appl. No.: 63,225

[22] Filed: Aug. 3, 1979

[51] Int. Cl.[3] ..... F22B 29/02; F22B 37/24

[52] U.S. Cl. ..... 122/235 A; 122/235 C; 122/510

[58] Field of Search ..... 122/235 A, 235 B, 235 C, 122/235 E, 420, 421, 510

[56] References Cited

U.S. PATENT DOCUMENTS

| | | | |
|---|---|---|---|
| 1,812,080 | 6/1931 | Chapman | 122/235 B |
| 1,871,937 | 8/1932 | Wilson | 122/421 |
| 1,961,138 | 6/1934 | Egloff | 122/235 C |
| 2,170,349 | 8/1939 | Bailey | 122/235 R |
| 3,060,908 | 10/1962 | Brister et al. | 122/235 C |
| 3,400,689 | 9/1968 | Bagley et al. | 122/510 |
| 3,927,646 | 12/1975 | Dungey et al. | 122/510 |
| 4,063,534 | 12/1977 | Kral | 122/510 |
| 4,178,881 | 12/1979 | Pratt et al. | 122/235 C |

FOREIGN PATENT DOCUMENTS

| | | | |
|---|---|---|---|
| 2733999 | 2/1979 | Fed. Rep. of Germany | 122/235 C |

*Primary Examiner*—Henry C. Yuen

*Attorney, Agent, or Firm*—Marvin A. Naigur; John E. Wilson; John J. Herguth, Jr.

[57] ABSTRACT

A vapor generator is provided for producing vapor such as steam to be used for heavy oil recovery and the like. The vapor generator includes an octagonal cross-section furnace, which has evaporator surface arranged to allow for heating of said fluid to final evaporation in a relatively low heat flux portion of the generator to lessen the likelihood of scale formation on heat transfer elements of the vapor generator.

10 Claims, 3 Drawing Figures

VAPOR GENERATOR

BACKGROUND OF THE INVENTION

This invention relates to vapor generation, and more specifically to generation of steam from contaminated feedwater, which steam can be used for recovery of sub-surface heavy oil and the like.

Steam injection is used for extraction of heavy oil and bitumin from deep deposits. In order to minimize costs, the water to be heated in a vapor generator to produce the steam for this injection is often taken from conveniently located surface sources of water, such as ponds and lakes, or is water recovered from underground with the oil or bitumin extracted from the deposits. The water taken from these sources is usually contaminated with salts or other solids which can accumulate as deposits or scale on inside walls of generator components as the water is heated while flowing through the vapor generator. Consequently, the vapor generator must frequently be shut down for cleaning, in order to avoid overheating and resultant failure of components upon which deposits have formed. This is especially true of tubular heat exchange elements disposed in high heat flux locations of the vapor generator. Although it is possible to treat the water before heating it, such treatment is relatively expensive and is thus limited to the minimum amount possible.

The present invention provides a vapor generator with an octagonal cross-section furnace characterized by a relatively large volume and moderate heat flux. The vapor generator includes evaporator surface located in a relatively low heat flux portion of the vapor generator. The vapor generator lends itself to in-shop fabrication, and because of the disposition of the final evaporaton surface in a low heat-flux location, the likelihood of scale formation is lessened and thus the period of operation between necessary cleanings is lengthened.

SUMMARY OF THE INVENTION

In accordance with an illustrative embodiment demonstrating features and advantages of the present invention, there is provided a vapor generator for generating steam from contaminated feedwater for use in heavy oil recovery and the like. The vapor generator comprises an economizer section, an evaporator section, means for introducing a vaporizable fluid to the economizer section, means for passing the fluid from the economizer section to the evaporator section, the evaporator section including first and second portions, the first portion including a plurality of fluid flow tubes defining a furnace enclosure having an octagonal cross section, the second portion including a plurality of fluid flow tube sections arranged in a serpentine bundle and adapted to be heated by convection, means for introducing hot gases to the vapor generator, means for passing the vaporizable fluid from the first portion of the evaporator section to the second portion of the evaporator section, and means for removing vaporized fluid from the second portion of the evaporator section.

DESCRIPTION OF THE PREFERRED EMBODIMENT

Figure 1:
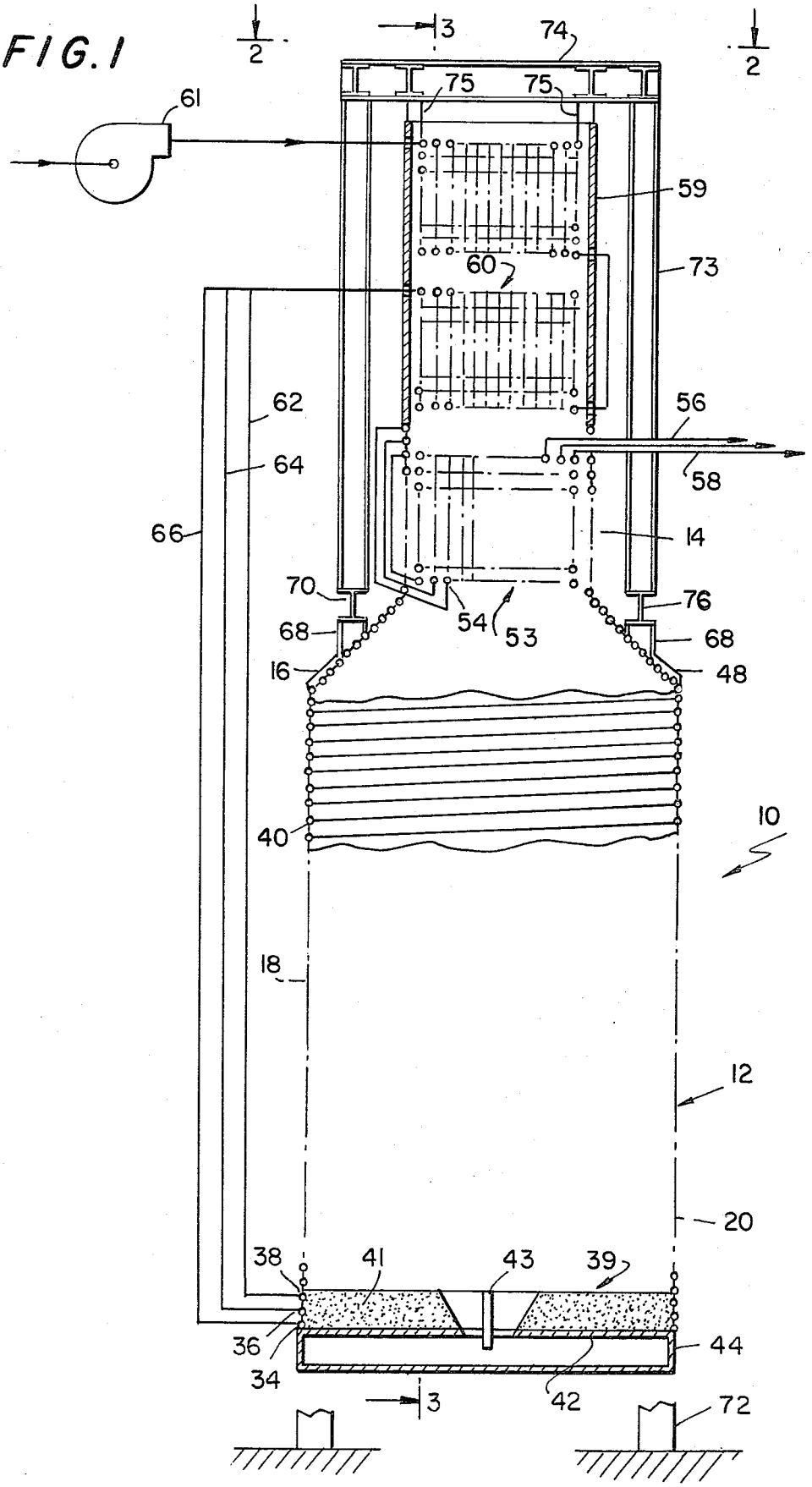
FIG. 1 is a frontal sectional view of the vapor generator of the present invention showing its support structure, as well as details of the fluid flow circuitry.
Figure 2:
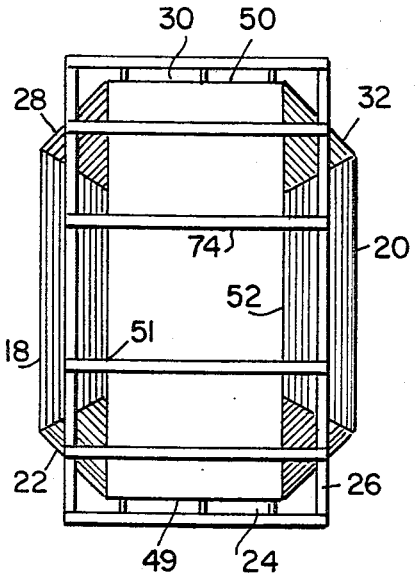
FIG. 2 is a plan view taken along line 2—2 of FIG. 1 showing portions of the support assembly of the vapor generator.

Turning to FIG. 1, a sectional view of the steam generator 10 of the present invention is represented. Steam generator 10 includes an upright furnace section 12, a convection section 14 disposed above furnace 12 and a transition section 16 connected between furnace section 12 and convection section 14. The furnace section 12 is defined by a plurality of walls 18–32, only two of which, 18 and 20, can be seen in FIG. 1. Each of the walls 18–32 is shown in FIG. 2, being arranged so as to define an octagonal furnace section. Returning to FIG. 1, walls 18–32 are made up of three fluid flow tubes 34, 36, and 38 wound in a generally spiral manner from an elevation adjacent a floor 39 up to an elevation adjacent transitiion section 16. The three spirally extending tubes are connected to one another by means of metal fins 40 so as to make the furnace section gas-tight. Each of the three upwardly extending tubes 34, 36 and 38 individually defines a fluid flow circuit through which a vaporizable fluid such as contaminated water can be passed. It should be understood that although three circuits are depicted, it is within the scope of the present invention to employ fewer or more circuits. It should be further understood that all sections of the fluid flow tubes defining the furnace need not extend at an angle to a horizontal plane. Some sections of these tubes, for example, sections defining six or seven walls, could extend horizontally, and other tube sections defining the remaining furnace walls can extend at an angle to a horizontal plane. Floor 39 of the furnace section 12 includes a metal plate 42 welded to furnace walls 18–32, and refractory covering 41. Burners 43 penetrate floor 39 and are adapted to introduce hot gases into the interior of the furnace section. A housing 44 is attached to the underside of plate 42, so as to define a windbox. In the preferred embodiment gas burners are used, but it should be understood that various other fuels, such as coal, oil or even refuse, can be fired. Because the volume of the furnace section 12 is relatively large, even when a low BTU gas is used, residence time of flue gas within the furnace enclosure is sufficiently long to allow for complete combustion of the fuel.

Hot gases introduced to the furnace 12 through burners 43 give off heat to the tubes 34, 36 and 38 which in turn transfer heat to the fluid flowing through them. At the top of furnace section 12 the wall-forming tubes 34, 36 and 38 continue to wind upwardly with sections of these tubes above furnace walls 18, 20, 22, 26, 28 and 32 bending inwardly, while tube sections above walls 24 and 30 continue upwardly in the plane of furnace walls 24 and 30 respectively. Transition section 16 is also gas-tight, with fins being secured between adjacent tubes where the spacing of tubes allows. These fins need not be uniform and in some portions of transition section 16 where tube spacing does not allow for fins, they may not be used. A skin casing 48 is provided above the outside surfaces of portions of transition section 16, in order to make this section gas-tight. At the upper extremity of transition section 16 the three circuit defining tubes 34, 36 and 38 are bent inwardly to form a generally rectangular convection section 14 which is defined by walls 49, 50, 51 and 52, as shown in FIG. 2.

Returning again to FIG. 1, tubes 34, 36 and 38 wind upwardly to the top of convection section 14. Each tube 34, 36 and 38 is secured to adjacent tubes by metal fins. Convection section 14 is open at its top to allow for removal of hot gases from vapor generator 10. The convection section 14 communicates with a downstream enclosure 59, within which is disposed a two section economizer 60.

At the top of convection section 14 the wall-forming tubes 34, 36 and 38 are bent outwardly from the convection section 14 and routed downwardly outside of the convection section 14. The three circuit defining tubes are then bent inwardly adjacent the bottom of convection section 14, penetrating the fin tube wall. These three tubes then communicate with a bundle 53 of straight tube sections 54 disposed within convection section 14. The tube sections 54 are connected by tube bends so as to define a serpentine bundle of tubes. Bundle 53 is heated by convection as the hot gases pass through convection section 14. Bundle 53 is disposed in a relatively low heat flux zone of the vapor generator 10, and therefore the fluid flowing through bundle 53 is heated at a relatively low rate. Fluid flowing through bundle 53 is being heated to a final desired stage of evaporation. As a consequence of the low heat flux associated with the heating of bundle 53 any scale tending to form on the inner walls of tube sections 54 would do so at a very slow rate.

After vaporizable fluid flows through bundle 53, the fluid is removed through parallel tubes 55, 56 and 58 which communicate with a downstream point of use, such as steam injectors.

As previously explained, a two section economizer 60 is disposed downstream of bundle 53. Although in the preferred embodiment a two section economizer 60 is employed downstream of bundle 53, it may be desired to use a single section economizer, or to locate the economizer or one section thereof upstream of bundle 53. A pump 61 forces feedwater from an external source (not shown) into economizer 60. Economizer 60 preheats the incoming feed, which then is sent via outside circuits 62, 64 and 66 to inlet ends of the three furnace wall tubes 34, 36 and 38.

Furnace section 12 of vapor generator 10 is supported from above. In FIG. 1 top support flanges 68 are shown attached between transition section 16 and beams 70, which as shown in FIG. 3, are attached to support legs 72.

Economizer 60 is also top-supported, being hung on rods 75 from horizontal members 74 which are attached to vertical members 73. Vertical members 73 are attached to beams 70, as shown in FIGS. 1 and 3.

Figure 3:
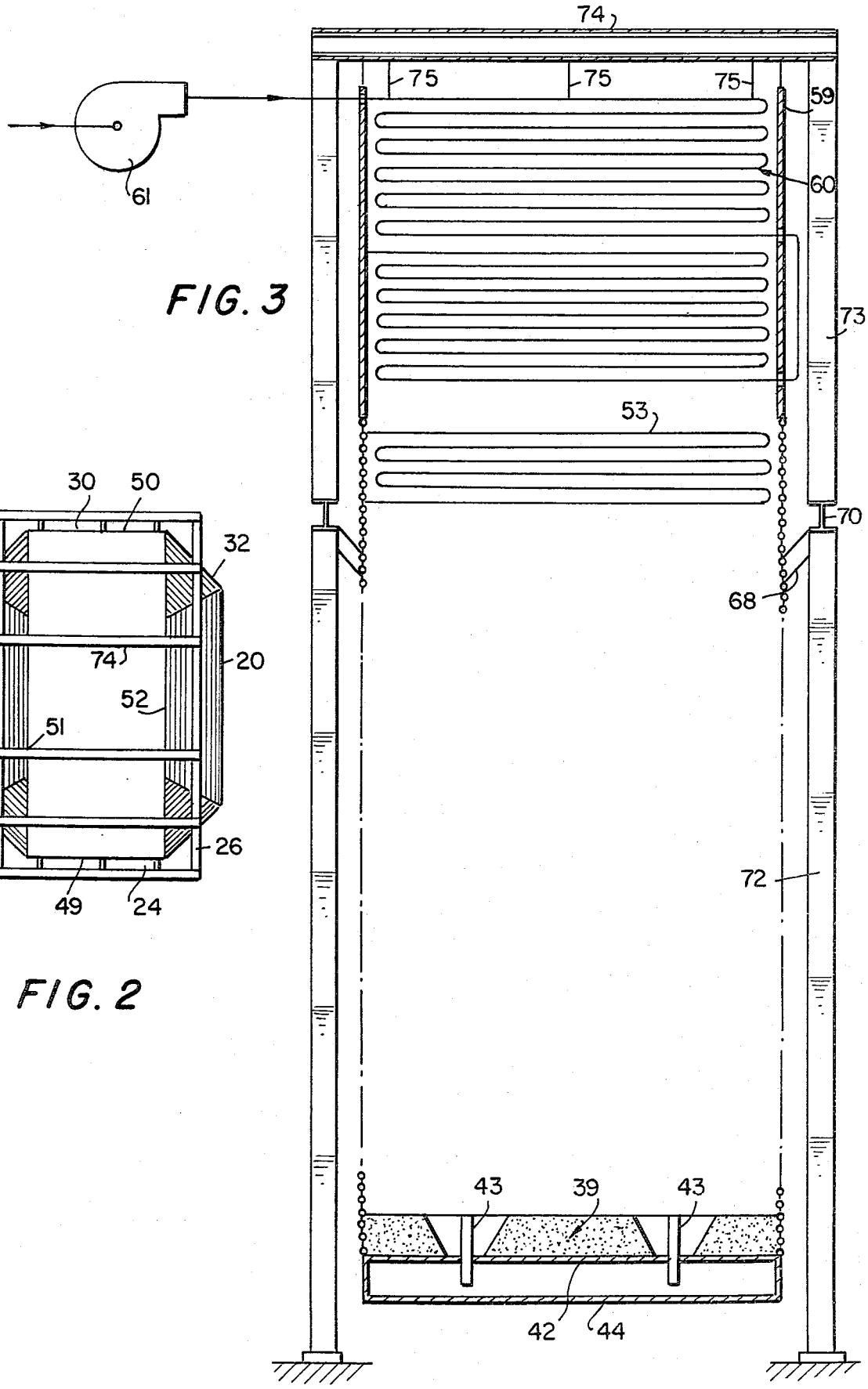
FIG. 3 is a sectional view of the vapor generator of the present invention taken along the line 3—3 of FIG. 1, showing the burners penetrating the floor of the furnace section.

As shown in FIG. 3, the ends of a pair of burners 43 penetrate furnace floor 39 from below. The octagonal cross section of furnace 12 allows for using a plurality of burners 43, thus incurring only moderate heat fluxes at the furnace tube walls. Because of the octagonal shape of the furnace, there are no deep corners disposed far from a burner. Therefore the fluid is nearly uniformly heated as it passes through the furnace wall tubes 34, 36 and 38.

From FIG. 3 it can be appreciated that front and rear walls of the transition section 16 continue upwardly in the plane of respective front and rear walls 24, 30 of furnace section 12. It is to be understood that conventional lagging, insulation and buckstay assemblies are to be included in the vapor generator, although not shown.

In operation a vaporizable fluid, such as contaminated water is introduced from an external source into vapor generator 10 by pump 61. The feedwater enters economizer 60, and is heated by hot gases passing through enclosure 59. The preheated feed is then routed by circuits 62, 64 and 66 to inlet ends of three upwardly extending fluid flow tubes 34, 36 and 38 which define furnace section 12. As the fluid flows through tubes 34, 36 and 38 it is heated by radiation. After passing through the furnace wall-forming tubes, the fluid then passes through tubes defining transition section 16, and subsequently through tubes defining walls of convection section 14. Adjacent the top of convection section 14 the fluid is routed via outside circuits to tube bundle 53 disposed within convection section 14. While flowing through bundle 53 the fluid is heated to a final desired evaporation by convection, and is then removed through tubular elements 55, 56 and 58. Tubular elements 55,56 and 58 can communicate with a point of use such as steam injectors used for heavy oil recovery.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A vapor generator for generating vapor from contaminated feed fluid comprising an economizer section; an evaporator section; means for introducing a vaporizable fluid to said economizer section; means for passing said fluid from said economizer section to said evaporator section; said evaporator section including first and second portions, said first portion comprising a plurality of fluid flow tubes defining a furnace enclosure including upright walls and a floor and having an octagonal cross section, said second portion comprising a plurality of fluid flow tubes arranged into a serpentine bundle and adapted to be heated by convection; burner means disposed in said furnace floor for introducing hot gases to said furnace enclosure; means for passing said vaporizable fluid from said first portion of said evaporator section to said second portion of said evaporator section; and means for removing vaporized fluid from said second portion of said evaporator section whereby said feed fluid can be uniformly heated as it flows through said furnace section and can be finally vaporized in a relatively low heat flux zone.

2. The vapor generator of claim 1 further comprising means for rigidly uniting said fluid flow tubes, said means and said fluid flow tubes together defining a gas-tight furnace enclosure, and wherein said means for introducing a vaporizable fluid to said economizer comprises means for introducing contaminated feedwater to said economizer.

3. The vapor generator of claim 2 wherein said means for passing said vaporizable fluid from said first portion of said evaporator section to said second portion of said evaporator section includes a plurality of fluid flow tubes defining a convection section adapted to receive said hot gases from said furnace enclosure, said second portion of said evaporator section being disposed within said convection section and being heated by said hot gases passing therethrough.

4. The vapor generator of claim 3 further comprising means for top-supporting said vapor generator.

5. The vapor generator of claim 4, said vapor generator further comprising a transition section connected between said furnace enclosure and said convection section, and wherein said means for top-supporting said vapor generator include an external superstructure disposed exterior of said steam generator, and means for attaching said furnace enclosure to said superstructure.

6. The vapor generator of claim 5 wherein said burner means for introducing hot gases to said furnace enclosure comprises a plurality of gas-fired burners.

7. The vapor generator of claim 6 wherein said plurality of fluid flow tubes defining said furnace enclosure comprises three helically arranged fluid flow tubes extending from an elevation adjacent said furnace floor up to an elevation adjacent said transition section.

8. The vapor generator of claim 7 further comprising a skin casing disposed around the outside of said transition section whereby said transition section is gas-tight.

9. The vapor generator of claim 8 wherein said economizer section comprises a first bundle of serpentine tube sections disposed above said second portion of said evaporator section, and a second bundle of serpentine tube sections disposed between said first bundle and said second portion of said evaporator section.

10. The vapor generator of claim 9 wherein said convection section further comprises means for rigidly uniting said plurality of fluid flow tubes defining said convection section such that said section is gas-tight.

* * * * *